US010758960B2

(12) United States Patent
Avrillaud et al.

(10) Patent No.: US 10,758,960 B2
(45) Date of Patent: Sep. 1, 2020

(54) CHAMBER FOR AN ELECTROHYDRAULIC FORMING DEVICE

(71) Applicant: ADM28 s.àr.l, Luxembourg (LU)

(72) Inventors: Gilles Avrillaud, Pinsaguel (FR); Samuel Ferreira, Toulouse (FR)

(73) Assignee: ADM28 S.àr.l, Luxembourg (LU)

( * ) Notice: Subject to any disclaimer, the term of this patent is extended or adjusted under 35 U.S.C. 154(b) by 262 days.

(21) Appl. No.: 15/540,938

(22) PCT Filed: Dec. 29, 2015

(86) PCT No.: PCT/EP2015/081372
§ 371 (c)(1),
(2) Date: Jul. 24, 2017

(87) PCT Pub. No.: WO2016/107881
PCT Pub. Date: Jul. 7, 2016

(65) Prior Publication Data

US 2017/0348751 A1 Dec. 7, 2017

(30) Foreign Application Priority Data

Dec. 29, 2014 (FR) ..... 14 63410

(51) Int. Cl.
*B21D 26/12* (2006.01)
*B21D 26/06* (2006.01)
(Continued)

(52) U.S. Cl.
CPC ..... *B21D 26/12* (2013.01); *B21D 26/02* (2013.01); *B21D 26/06* (2013.01); *B21D 26/027* (2013.01)

(58) Field of Classification Search
CPC ..... B21D 26/12; B21D 26/02; B21D 26/06; B21D 26/00; B21D 26/14; B21D 26/031;
(Continued)

(56) References Cited

U.S. PATENT DOCUMENTS 3,149,372 A * 9/1964 Stinger ..... B21D 26/14 264/84
3,163,141 A 12/1964 Wesley et al.
(Continued)

FOREIGN PATENT DOCUMENTS

CH 659406 A5 * 1/1987 ..... B21D 26/08
DE 719055 C * 3/1942 ..... B21D 26/00
(Continued)

OTHER PUBLICATIONS

Stadelmann et al., CH 659406 A5, Machine Translation of Patent (Year: 1987).*
(Continued)

*Primary Examiner* — Teresa M Ekiert
*Assistant Examiner* — Sarkis A Aktavoukian
(74) *Attorney, Agent, or Firm* — Seed Intellectual Property Law Group LLP

(57) ABSTRACT

An electrohydraulic forming device includes a tank having a tank inner wall and inside of which are positioned a mold, a first electrode, and a second electrode. A free first reflector is placed in the tank and surrounds the mold, the first electrode, and the second electrode.

9 Claims, 3 Drawing Sheets

Figure 1:
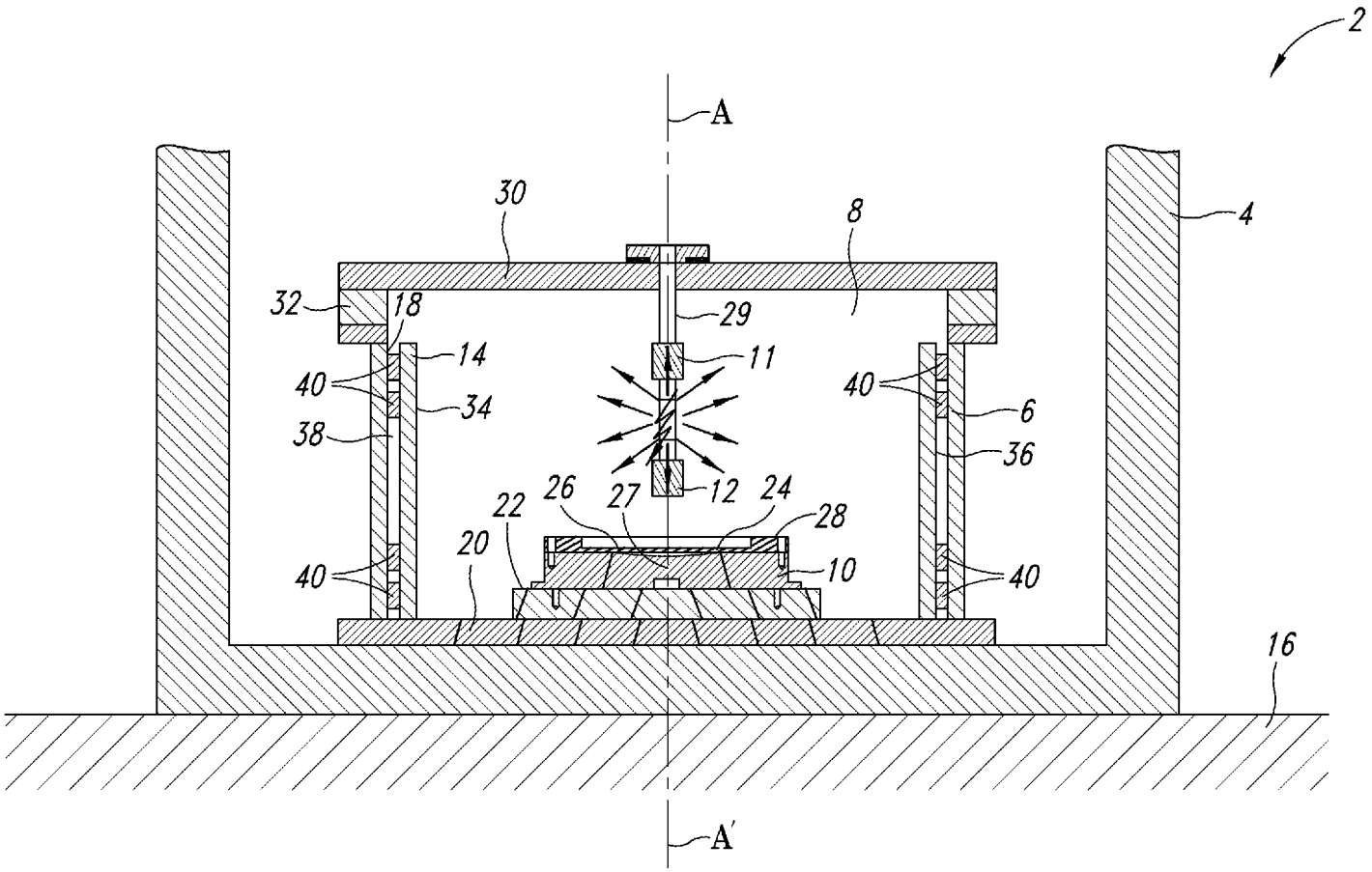

(51) Int. Cl.
*B21D 26/02* (2011.01)
*B21D 26/027* (2011.01)

(58) Field of Classification Search
CPC .. B21D 26/047; B21D 26/025; B21D 26/039; B21D 22/205; Y10T 29/49806
USPC ..... 72/56
See application file for complete search history.

(56) References Cited

U.S. PATENT DOCUMENTS

| | | | | | |
|---|---|---|---|---|---|
| 3,177,689 | A * | 4/1965 | Landon | B21D 26/08 | 29/421.2 |
| 3,214,950 | A * | 11/1965 | Nemitz | B21D 26/08 | 72/56 |
| 3,232,085 | A * | 2/1966 | Inoue | B21D 26/12 | 29/421.2 |
| 3,403,539 | A * | 10/1968 | Nemitz | B21D 26/06 | 72/56 |
| 3,487,526 | A * | 1/1970 | Derzee | B21D 26/12 | 29/732 |
| 3,631,701 | A * | 1/1972 | Hertel | B21D 26/06 | 72/56 |
| 3,641,796 | A * | 2/1972 | Hertel | B21D 26/06 | 72/56 |
| 3,643,482 | A * | 2/1972 | Hertel | B21D 26/06 | 72/56 |
| 3,662,577 | A * | 5/1972 | Nicot | B21D 26/08 | 72/56 |
| 4,174,624 | A * | 11/1979 | Shrum | F42D 5/04 | 72/56 |
| 4,534,831 | A * | 8/1985 | Inoue | C25D 1/00 | 204/216 |
| 6,591,649 | B1 | 7/2003 | Gafri et al. | | |
| 7,802,457 | B2 | 9/2010 | Golovaschenko et al. | | |
| 2010/0154502 | A1 | 6/2010 | Johnson-Morke et al. | | |
| 2014/0053622 | A1 | 2/2014 | Bonnen et al. | | |

FOREIGN PATENT DOCUMENTS

| | | | | |
|---|---|---|---|---|
| FR | 2018860 | A1 * | 6/1970 | B21D 26/06 |
| FR | 2536425 | A1 * | 5/1984 | C25D 1/00 |
| JP | S54155971 | A | 12/1979 | |
| JP | S59191580 | A | 10/1984 | |

OTHER PUBLICATIONS

Machine Translation of FR-2018860-A1, Heinrich, Publication year 1970, Total pp. 9 (Year: 2019).*

* cited by examiner

CHAMBER FOR AN ELECTROHYDRAULIC FORMING DEVICE

The present invention relates to a chamber for an electrohydraulic forming device.

Electrohydraulic forming devices are increasingly being used for the production of mechanical parts. Indeed, this forming technology makes it possible to obtain parts of relatively complex appearance while controlling the production costs. For example, the automotive and aerospace industries use such technologies.

A hydraulic forming process is a process of manufacturing by deformation. It enables plastic deformation of a metal part of relatively small thickness. To achieve this deformation, a fluid is used which, when pressurized, enables the deformation of said part on a mold. Several techniques are used to pressurize the fluid.

One of the processes used is an electrohydraulic forming process. This process is based on the principle of an electrical discharge in the fluid stored in a tank. The released amount of electric energy generates a pressure wave which propagates in the fluid, enabling plastic deformation of the mechanical part against the mold. To do this, electrodes positioned in the fluid are adapted to release an electrical charge stored in energy storage capacitors.

The use of a closed enclosure improves the forming of the part in comparison to a tank without a cover. The pressure waves are confined within the closed enclosure and reflected waves contribute to shaping the part.

U.S. Pat. No. 6,591,649 discloses an electrohydraulic forming device comprising a tank that is substantially elliptical and closed by a mold, a workpiece, and a set of electrodes coupled to an electric energy storage device adapted to generate a pressure wave. This pressure wave, of relatively high power, strikes both the workpiece and the tank of the electrohydraulic forming device. During production phases, these repeated impacts can lead to premature wear of the tank and issues with failing welds on certain parts of the electrohydraulic forming device.

Document US2010/0154502 discloses a method and a device for rapidly producing casings for medical use. The rapid formation of these casings is achieved by creating a pressure wave in a liquid contained in an enclosure. A die and a workpiece to be formed are placed in the path of the pressure wave within the enclosure and the pressure wave forces the workpiece to the contours of the die.

In order to improve the life of the tank, high density materials capable of withstanding such impacts are used, for example such as metal alloys of relatively large thicknesses. However, the use of thick walls results in a significant increase in the mass of the tanks, particularly for tanks of large dimensions.

In order to reduce this mass, stiffeners can be installed outside the walls to increase their rigidity while reducing their thickness. This technological solution does not offer satisfactory results, however.

The object of the present invention is to propose an electrohydraulic forming device comprising a tank of improved reliability compared to devices of the prior art, while reducing the mass of the tank and maintaining high forming efficiency. In addition, the invention will advantageously provide an electrohydraulic forming device having a controlled manufacturing cost.

To this end, the invention proposes an electrohydraulic forming device comprising a tank having a tank inner wall and inside of which are positioned a mold, a first electrode, and a second electrode. According to the invention, a free first reflector is placed in the tank and surrounds the mold, the first electrode, and the second electrode.

The reflector is free because it is not rigidly connected to the tank and/or to the elements secured to the tank. It is mounted in the tank so as to be able to move with respect to the tank. Of course, these movements must be restricted and controlled. Due to the presence of the first reflector, the tank is subjected to less stress from the pressure waves triggered by an electric arc between the first electrode and the second electrode. Indeed, the pressure waves are mostly reflected by the first reflector, which reduces the stresses on the tank inner wall.

In order to distribute the pressure waves uniformly, the first reflector is for example cylindrical in shape. The cross-section of this cylindrical shape then depends for example on the part to be formed. In a variant embodiment, this first reflector will be of circular cylindrical shape.

According to one embodiment, the first reflector is positioned concentrically with respect to the mold whose shape generally corresponds to that of the part to be formed.

In order to better resist the pressure waves and thus better protect the tank, the first reflector is preferably composed of a metal or a metal alloy.

In a variant embodiment, a second reflector is preferably placed substantially parallel to a cover, between the first electrode and said cover. The inertia of the device according to the invention is thus improved.

In order to improve the performance of the device, the second reflector has a disc shape for example, providing better confinement of the pressure waves when the first reflector is of circular cylindrical shape. The second reflector is connected to the cover, for example by connecting means in the form of dampers. The second reflector can thus move with at least one degree of freedom relative to the cover.

In one exemplary embodiment, a space separates the tank inner wall from a reflector outer wall of the first reflector and is filled with the same fluid as the tank, so that the tank is less exposed to the pressure waves during a forming process.

Figure 2:
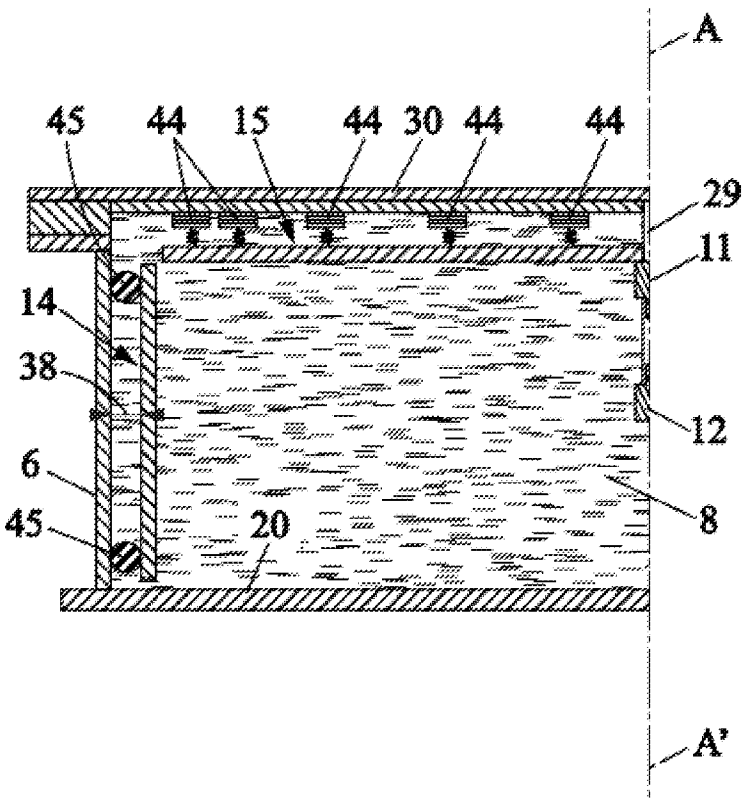
Figure 3:
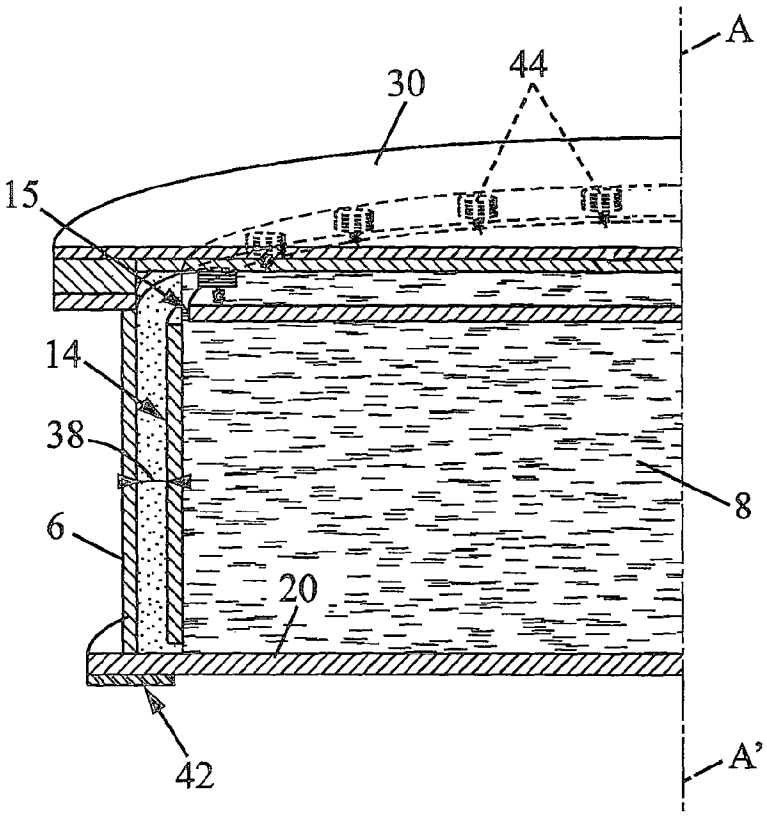

Features and advantages of the invention will be more apparent from the following description, made with reference to the accompanying schematic drawing in which:

FIG. 1 is a schematic simplified cross-sectional view of an electrohydraulic forming device according to the invention, FIG. 2 is a partial schematic view of another embodiment of the invention, and FIG. 3 is a partial perspective view of an electrohydraulic forming device according to another embodiment.

FIG. 1 shows an electrohydraulic forming device 2 comprising a frame 4, a tank 6, a mold 10, a first electrode 11, a second electrode 12, and a first reflector 14.

The frame 4 is adapted to support and hold the tank 6 on a base 16 which may be made of metal or concrete for example. The frame 4 may be made of a metal or a metal alloy, for example such as hardened steel.

The tank 6 is adapted to receive and contain a fluid 8 which is water in our example. Preferably, the tank 6 is of cylindrical shape of a given height and has a vertical axis of symmetry A-A' (FIG. 1). It also has a tank inner wall 18 and a tank bottom 20. Preferably, it is made of a metal of a thickness of about 5 cm (1 cm=0.01 m).

A cover 30 is placed on the tank 6 and is secured by suitable fastening means (not shown in the figures) to hold the cover 30 on the tank 6 during execution of a forming process. Also, a seal 32 between the edge of the tank 6 and the edge of the cover 30 is used.

The mold 10 is preferably centered on the vertical axis of symmetry A-A' of the tank 6. It has a cavity 24 fixed to a mold support 22, for example by means of screws. In addition, the mold 10 comprises internal piping 27 coupled to a pumping device (not visible in the figures) making it possible to obtain the desired vacuum under a part to be formed 26. Thus, during the process of forming the part to be formed 26, there is no counter-reaction (caused by the presence of air between the part to be formed 26 and the mold cavity 24) to oppose the deformation of the part. A fastening device 28 is positioned facing the mold 10 and holds the part to be formed 26 in the desired position.

The first electrode 11 and the second electrode 12 are positioned in the tank 6, preferably on the vertical axis of symmetry A-A'. They are adapted to generate at least one electric arc in the fluid 8. The first electrode 11 and the second electrode 12 are spaced apart by an adjustable inter-electrode space (FIG. 1).

The first electrode 11 and the second electrode 12 are held in the tank 6 by means of a rod 29 (FIG. 1) fixed to the cover 30. The rod 29 has an adjustable length, making it possible to control the distance between the mold 10 and the second electrode 12.

The generation of an electric arc between the first electrode 11 and the second electrode 12 allows creating pressure waves in the fluid 8, called direct pressure waves, in order to deform the part to be formed 26. The direct pressure waves propagate concentrically relative to the inter-electrode space (represented by solid arrows in FIG. 1).

The first reflector 14 is positioned in the tank 6 and is preferably cylindrical in shape. It has a diameter adapted to surround the mold 10 as well as the first electrode 11 and the second electrode 12. The first reflector 14 has a reflector inner wall 34 and a reflector outer wall 36. The first reflector 14 can move freely within the tank 6 and can be moved in a controlled manner in the tank with at least one degree of freedom. In addition, it must be sufficiently rigid to withstand the pressure waves and reflect them. It is made for example of a metal or a metal alloy and it has a thickness for example of about 3 cm.

The diameter of the first reflector 14 is such that a space 38 (FIG. 1) is present between the tank inner wall 18 and the reflector outer wall 36 of the first reflector 14. In the exemplary embodiments of FIGS. 1 and 2, this space 38 contains the same fluid 8 as the fluid contained in the tank 6. Thus, the tank inner wall 18 is subjected to less stress during a forming process, making it possible to reduce its thickness.

In this embodiment, shims 40 positioned between the tank inner wall 18 and the reflector outer wall 36 may be used to hold the first reflector 14 in place in the tank 6. They are positioned on a lower portion and/or an upper portion of the first reflector 14 by retaining means (not shown in the figures). Thus, the shims 40 allow maintaining the first reflector 14 in an optimal position before, during, and after the process of forming the part to be formed 26.

In a preferred embodiment, the diameter of the first reflector 14 is substantially larger than the diameter of the mold 10 containing the part to be formed 26. Thus, the pressure waves are sent to a work surface corresponding to the surface of the part to be formed 26, optimizing the forming process. The use of such a first reflector 14 makes it possible to minimize the exposure of the tank bottom 20, and in particular the connecting region between the tank inner wall 18 and the tank bottom 20, to pressure waves during a forming process, thereby improving the service life of the tank 6.

Furthermore, in addition to the direct pressure waves, pressure waves called indirect pressure waves are applied to the surface of the part to be formed 26. The indirect pressure waves result from the reflection of a portion of the direct pressure waves on the reflector inner wall 34 and on the cover 30. This thus increases the time during which pressure is applied to the part 26 to be formed, improving the forming process.

The embodiment of FIG. 2 adopts the same geometry as that disclosed in FIG. 1. In this variant, in order to reduce the impact of the pressure waves on the tank 6, an air cushion 45 filled with pressurized air is positioned in the space 38 between the tank inner wall 18 and the reflector outer wall 36. The air cushion 45, made of synthetic material, is of toric shape for example (FIG. 2) and can be positioned anywhere along the height of the first reflector 14.

It is also possible to use a plurality of air cushions. For example, two air cushions 45 positioned respectively on an upper part of the first reflector 14 and on a lower part of the first reflector 14 may be used to reduce the impact of the pressure waves on the tank 6 while maintaining the first reflector 14 in an optimal position, as illustrated in FIG. 2.

In the embodiment of FIG. 2, one will also note the presence of a second disc-shaped reflector 15 with a diameter adapted to the diameter of the first reflector 14. This second reflector 15 substantially closes off the top of the first reflector 14 and is also immersed in the tank 6 (FIG. 2). The second reflector 15 is positioned between the first electrode 11 and the cover 30. It is spaced apart from the cover 30 and is substantially parallel to the cover. It is free to move relative to the tank 6 with at least one degree of freedom. Advantageously, it makes it possible to increase the inertia of the first reflector 14.

The space between the second reflector 15 and the cover 30 is filled with fluid 8 from the tank 6 but may possibly also have a pressurized air cushion. The damping or absorption of pressure waves by the device is thus improved.

The second reflector 15 is preferably connected to the cover 30 by suitable connecting means 44, for example such as pneumatic or elastomeric shock absorbers. They may be arranged along the entire periphery of the cover 30 in one exemplary embodiment.

In another embodiment illustrated in FIG. 3, the space 38 between the tank inner wall 18 and the reflector outer wall 36 is filled with air that can be pressurized. In this exemplary embodiment, a circular envelope made of synthetic material can store air at a given pressure and thus provide a seal between the air (contained in the circular envelope) and the water contained in the tank 6. Due to the greater capacity for deformation of air compared to water, the transmission of pressure waves towards the tank 6 is attenuated. The tank 6 is thus subjected to less stress, making it possible to reduce the thickness of the tank 6 and hence its mass.

In order to protect the base 16 from possible vibrations generated by the pressure waves, supports 42 (FIG. 3) are positioned between the tank 6 and the frame 4. They are preferably positioned along a periphery of the tank 6. The thickness of the supports 42 as well as the material used are adapted to distribute the forces from the tank 6 onto the frame 4 during the forming process.

The present invention therefore proposes an electrohydraulic forming device with at least one reflector positioned in the tank, making it possible to reduce the impact of the pressure waves on the tank and thus increase its service life. Moreover, the presence of at least one reflector in the tank makes it possible to decrease the thickness of the tank and hence its mass.

The invention is not limited to the embodiments described above by way of non-limiting examples and to the shapes represented in the drawing and the other variants mentioned, but relates to any embodiment that is within the reach of a person skilled in the art and within the scope of the following claims.

The invention claimed is:

1. An electrohydraulic forming device comprising:

a tank having a tank inner wall, a mold, a first electrode, and a second electrode positioned in the tank, a free first reflector placed in the tank and surrounding the mold, the first electrode, and the second electrode, wherein the free first reflector can be moved in a controlled manner in the tank with at least one degree of freedom, the free first reflector is made of one single part, and the free first reflector is cylindrical in shape, a cover, and a second reflector extending substantially parallel to the cover, and placed between the first electrode and said cover.

2. The electrohydraulic forming device according to claim 1, wherein the free first reflector is of circular cylindrical shape.

3. The electrohydraulic forming device according to claim 2, wherein the free first reflector is positioned concentrically with respect to the mold.

4. The electrohydraulic forming device according to claim 1, wherein the free first reflector is composed of a metal or a metal alloy.

5. The electrohydraulic forming device according to claim 1, wherein the free first reflector is of circular cylindrical shape and the second reflector has a disc shape.

6. The electrohydraulic forming device according to claim 1, wherein the second reflector is connected to the cover by dampers.

7. The electrohydraulic forming device according to claim 1, wherein a space separates the tank inner wall from a reflector outer wall of the free first reflector and is filled with a fluid that also fills the tank.

8. An electrohydraulic forming device, comprising:

a tank having a tank inner wall;

a mold, a first electrode, and a second electrode positioned in the tank;

a free first reflector placed in the tank and surrounding the mold, the first electrode, and the second electrode, wherein the free first reflector can be moved in a controlled manner in the tank with at least one degree of freedom;

shims configured to maintain the free first reflector in a position in the tank;

a cover; and a second reflector extending substantially parallel to the cover, and placed between the first electrode and said cover.

9. An electrohydraulic forming device, comprising:

a tank having a tank inner wall;

a mold, a first electrode, and a second electrode positioned in the tank;

a free first reflector placed in the tank and surrounding the mold, the first electrode, and the second electrode, wherein the free first reflector can be moved in a controlled manner in the tank with at least one degree of freedom;

at least one pressurized air cushion positioned between the free first reflector and a wall of the tank and configured to maintain the free first reflector in a position in the tank;

a cover; and a second reflector extending substantially parallel to the cover, and placed between the first electrode and said cover.

* * * * *